US010643588B1

(12) United States Patent
Doherty

(10) Patent No.: US 10,643,588 B1
(45) Date of Patent: May 5, 2020

(54) DRUM TUNING APPARATUS

(71) Applicant: Conan Doherty, Water Mill, NY (US)

(72) Inventor: Conan Doherty, Water Mill, NY (US)

( * ) Notice: Subject to any disclaimer, the term of this patent is extended or adjusted under 35 U.S.C. 154(b) by 0 days.

(21) Appl. No.: 16/520,648

(22) Filed: Jul. 24, 2019

Related U.S. Application Data

(60) Provisional application No. 62/713,041, filed on Aug. 1, 2018.

(51) Int. Cl.
*G10G 7/02* (2006.01)
*G10D 13/02* (2020.01)

(52) U.S. Cl.
CPC ..... *G10D 13/023* (2013.01)

(58) Field of Classification Search
CPC ..... G10D 13/023
USPC ..... 84/454, 411 R, 413
See application file for complete search history.

(56) References Cited

U.S. PATENT DOCUMENTS

| | | | | |
|---|---|---|---|---|
| 151,797 | A | 6/1874 | Rawson | |
| 1,484,777 | A | 2/1924 | Hassenpflug | |
| 2,132,105 | A | 10/1938 | Gladstone | |
| 3,113,481 | A | 12/1963 | Thompson | |
| 3,139,783 | A | 7/1964 | Grant | |
| 3,165,964 | A | 1/1965 | Stys | |
| 4,208,942 | A * | 6/1980 | Henrit | G10D 13/00 411/435 |
| 4,218,952 | A | 8/1980 | Arbiter | |
| 4,287,806 | A | 9/1981 | Neary | |
| 4,541,322 | A | 9/1985 | Calato | |
| 4,870,883 | A | 10/1989 | Gauger | |
| 5,193,418 | A | 3/1993 | Behrenfeld | |
| D366,996 | S | 2/1996 | Torres | |
| 5,689,076 | A | 11/1997 | Usuda | |
| 5,693,900 | A | 12/1997 | Cabato | |
| 5,739,448 | A | 4/1998 | Toscano | |
| 5,977,463 | A | 11/1999 | Bartlett | |
| 6,242,680 | B1 | 6/2001 | Benton | |
| 7,244,882 | B1 * | 7/2007 | Colwell | G10D 13/00 84/312 R |
| 7,351,900 | B2 * | 4/2008 | May | G10D 13/00 84/413 |

(Continued)

FOREIGN PATENT DOCUMENTS

| | | |
|---|---|---|
| DE | 20206104 | 9/2002 |
| JP | 2009172747 | 8/2009 |
| JP | 3186182 | 9/2013 |

*Primary Examiner* — Jianchun Qin
(74) *Attorney, Agent, or Firm* — Thomas A. O'Rourke; Bodner & O'Rourke, LLP

(57) ABSTRACT

A drum tuning apparatus includes: a shaft having a first end separated from a second end by a distance; a percussion mallet formed on the first end of the shaft; and an elongated member that extends from the shaft substantially transverse with respect to an axis of the shaft. A distal end of the elongated member has an opening defining a recess that is shaped and sized to receive a lug of a drum tension rod therein. An outer surface of the elongated member proximate to its distal end may be formed as a cylindrical surface. A second percussion mallet may be formed on the second end of the shaft such that the drum tuning apparatus can tune different types of percussion instruments without having to use different tools. The first percussion mallet may be a snare drum tip, and the second percussion mallet may be a bass drum tip.

7 Claims, 12 Drawing Sheets

(56) References Cited

U.S. PATENT DOCUMENTS

| | | | | |
|---|---|---|---|---|
| 7,495,161 | B1 | 2/2009 | Richards | |
| 9,773,481 | B1 | 9/2017 | Goldsmith | |
| 9,934,764 | B2 | 4/2018 | Jones | |
| 2003/0159550 | A1 | 8/2003 | Shigenaga | |
| 2005/0056137 | A1 | 3/2005 | DiPietro | |
| 2007/0163400 | A1* | 7/2007 | Parise | B25B 13/48 81/176.1 |
| 2007/0193433 | A1 | 9/2007 | Takegawa | |
| 2008/0022840 | A1 | 1/2008 | May | |
| 2009/0064844 | A1 | 3/2009 | O'Connor | |
| 2014/0026732 | A1* | 1/2014 | Spinazzola | G10D 13/028 84/413 |
| 2014/0165819 | A1 | 6/2014 | McGee | |

* cited by examiner

DRUM TUNING APPARATUS

CROSS REFERENCES TO RELATED APPLICATIONS

This application claims priority on U.S. Provisional Application Ser. No. 62/713,041, filed on Aug. 1, 2018, having the title "Drum Tuning Key with Elongated Head Formed as a Double Mallet," the disclosures of which are incorporated herein by reference.

FIELD OF THE INVENTION

The subject technology relates generally to equipment and a method for tuning of percussion instruments, and more particularly to an improved apparatus and method for tuning a drum.

BACKGROUND OF THE INVENTION

Pitched percussion instruments (e.g., drums such as a snare drum and a bass drum) need to be properly tuned. The drums are made of a hollow cylindrical barrel, typically composed of multiple different wood species, with a "batter" head (i.e., the head that the drum stick strikes to produce sound) being placed on the top side of the barrel and secured thereto using a metal or wood hoop, and a resonant head placed on the bottom of the barrel, being secured thereto using another hoop. The hoops are secured to the barrel using a plurality of tension rods (usually at least six and sometimes more than twelve rods) that are threadably connected to mountings on the barrel. The tension rods usually terminate in a square-shaped head (a "lug") that may be rotated using a tuning key that may have an opening that matches the cross-sectional shape of the tuning screw head. In general each of the batter head and the resonant head are tuned by adjusting the tension in each of the tension rods in a meticulous process.

The process starts with the bottom head—the resonant head, which is often clear, as opposed to the top (batter) head which is often coated with a white thick textured coating.

Each of the tensioning rods of the resonant head are successively finger tightened to begin with very even tension on each of the lugs.

After the initial finger tightening, the person tuning the drum will "break in" the head, if new, by depressing the head with both fists across the surface of the head, which makes the head sit better.

Next, each lug is again successively retightened by hand, as breaking in the head may have resulted in it loosening proximate to at least some of the tensions rods.

Then palm pressure is applied using one hand on the hoop at each of the lug locations, one at a time, and the lugs are again finger tightened while the pressure is applied, with the use of the same amount of pressure at each lug location. Use of the pressure also serves to better seat the head, and gets the drum close to the desired pitch. This hand tightening while pressure is applied creates very even tension, probably even better than may initially be obtained using a drum key, because there is less of a sense of feel using the key, which may tend to apply disparate amounts of torque depending upon where the user grasps the head ("bow") of the key with his/her thumb and forefinger. Grasping the head of the key even slightly differently using only those two fingers may produce different lever arms, resulting in a disparate amount of tension in each of the lugs. Also, overtightening may stretch the head and subsequently make it very difficult to tune properly.

Next, the batter head is tightened according to each of the above steps that were used for the resonant head.

Then, the key is used to tighten each one of the lugs of the resonant head first, in a star pattern, successively tightening the pairs of lugs that are opposite each other. Each one is successively tightened one-half of a turn of the key (i.e., rotation of 180 degrees of the key), which generally provides for the same amount of additional tension for each lug location. Then the key is used again to tighten each lug in the same star pattern, but this time only one-quarter of a turn (i.e., 90 degrees of rotation).

Next the tuning at each lug location is checked by successively tapping on the head in proximity to each of the lugs using a finger (e.g., a fore finger). The sounds produced at each of the locations may be compared to see if the pitch is close. A location that is either low or high may respectively be adjusted by a slight turn of the key for added or reduced tensioning of the particular lug.

The batter head may then be tightened using the key using the same steps that were used for the resonant head, but initially using one-quarter of a turn (90 degrees).

A few different methods can be used for the final tuning of the drum. It is desirable to tune for the responsiveness of the head, and also to tune for the relationship between the different drums used (e.g., the toms may be related by thirds in pitch).

The resonant head and the batter head may also be tuned to the same pitch or may be tuned to be related in pitch (e.g., related by thirds). The related tuning of the batter head and resonant head depends on the number of plies of each head, for example, where the batter head is a two-ply head and the resonant head is a one-ply head (i.e., thinner), the bottom head will naturally be higher in pitch when at the same tension.

To fine tune the batter head for any of those approaches, the resonant head is held with a first hand to keep it from resonating to get a good clear tone from the batter head, which first hand may also be grasping the key. Then a drum stick held in the second hand is used to successively tap on the batter head proximate to each lug location. Any of the lug locations that may be low or high with respect to a musical note to which the head is being tuned are then adjusted using the key held in the first hand, which first hand may repeatedly go back and forth between the holding the resonant head and the making of small adjustments to the tension of the lugs that may be slightly off. This back and forth motion for fine tuning of each of the drums is slow and laborious. Also, because the head of the drum key is generally finger sized, it is often difficult to tell whether or not it has been turned close to the prescribed 180 degrees or to the prescribed 90 degrees, when required prior to the fine tuning steps, which may cause tone discrepancies.

The present invention solves these and other problems.

OBJECTS OF THE INVENTION

It is an object of the invention to provide an improved method for tuning a pitched percussion instrument.

It is another object of the invention to provide apparatus that makes it easier to tune a pitched percussion instrument.

It is a further object of the invention to provide apparatus that allows a pitched percussion instrument to be tuned faster.

It is another object of the invention to provide apparatus that allows a pitched percussion instrument to be tuned more precisely.

It is also an object of the invention to provide apparatus that eliminates the awkwardness in the fine tuning of a pitched percussion instrument.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least a first embodiment a drum tuning apparatus may include: a shaft that extends from a first end to a second end, the first end of the shaft being separated from the second end of the shaft by a distance L; a percussion mallet formed on the first end of the shaft; and an elongated member that extends from the shaft substantially transverse with respect to an axis of the shaft. A distal end of the elongated member has an opening defining a recess, where the recess is shaped and sized to receive a lug of a drum tension rod therein. An outer surface of the elongated member proximate to its distal end may preferably be formed as a cylindrical surface. In another embodiment, a drum tuning apparatus may additionally include a second percussion mallet formed on the second end of the shaft; such that the drum tuning apparatus is more particularly configured to tune different types of percussion instruments without having to use different tools. In one version of this embodiment the first percussion mallet may be a snare drum tip, and the second percussion mallet may be a bass drum tip. In one embodiment a proximal portion of the elongated member may be received in an orifice in the shaft in a friction fit to secure the elongated member to the shaft. Alternatively, a proximal portion of the elongated member may be releasably secured to the shaft using a mechanical fastener. In yet another embodiment, the elongated member may be integrally formed with the shaft.

BRIEF DESCRIPTION OF THE DRAWINGS

The description of the various example embodiments is explained in conjunction with appended drawings, in which.

DETAILED DESCRIPTION OF THE INVENTION

Figure 1:
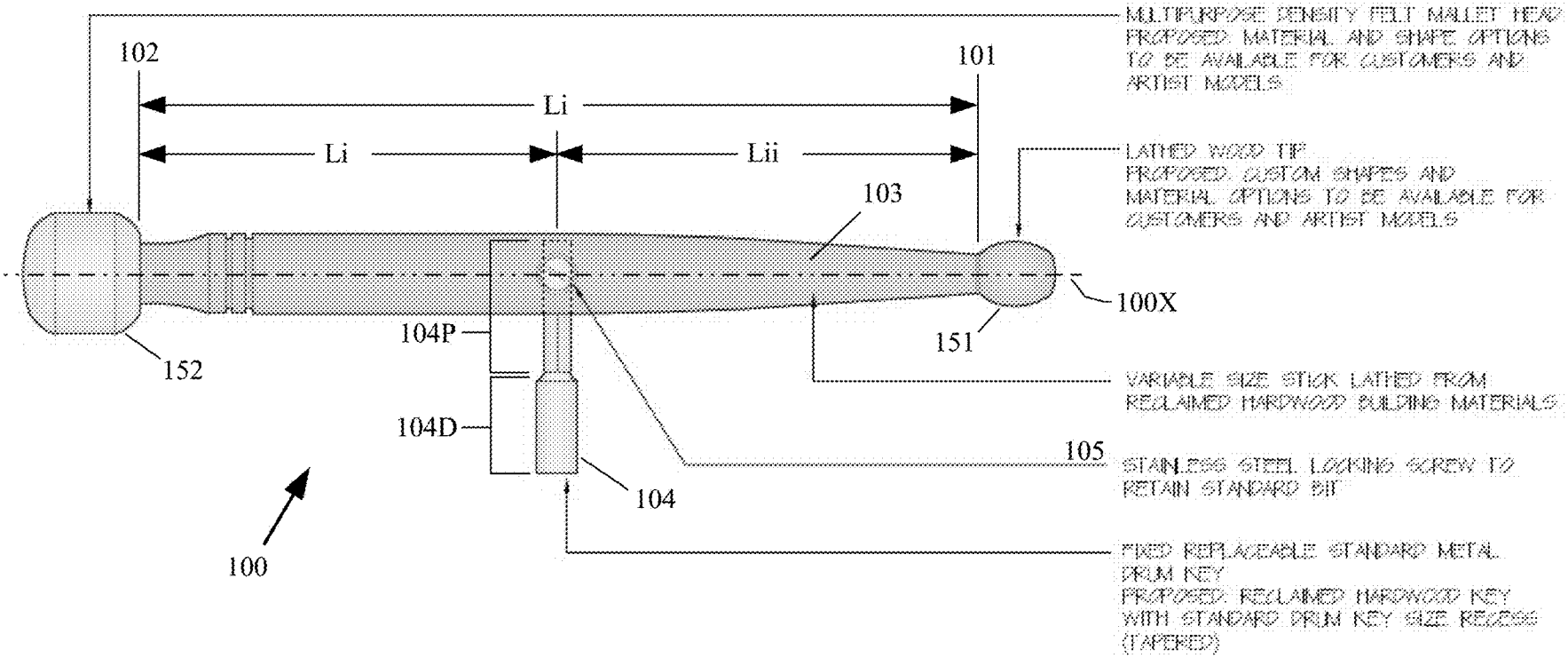
FIG. 1 illustrates a drum tuning key with elongated head formed as a double-ended mallet in accordance with a first embodiment of the present invention.

As used throughout this specification, the word "may" is used in a permissive sense (i.e., meaning having the potential to), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, it is noted that citing herein of any patents, published patent applications, and non-patent literature is not an admission as to any of those references constituting prior art with respect to the disclosed apparatus.

Furthermore, the described features, advantages, and characteristics of any particular embodiment disclosed herein, may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of a multiplicity of such individual tolerances.

Any use of a friction fit (i.e., an interface fit) between two mating parts described herein indicates that the opening (e.g., a hole) is smaller than the part received therein (e.g., a shaft), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit—i.e., loose running, free running, easy running, close running, and sliding (e.g., for a 0.1250 inch shall diameter the opening may be 0.1285 inches for a close running fit, and may be 0.1360 inches for a free running fit; for a 0.5000 inch diameter shaft the opening may be 0.5156 inches for a close running fit and may be 0.5312 inches for a free running fit). Other clearance amounts are used for other clearance types. See "Engineering Fit" at: https://en.wikipedia.org/wiki/Engineering_fit; and "Three General Types of Fit." available at www.mmto.org/dclark/Reports/Encoder%20Upgrade/fittolerences%20%5BRead-Only%5D.pdf.

As used herein, the term "hand-held" describes an item, at least one part of which is easily and conveniently handled in an average-sized human hand. Preferably, this term indicates that the entire item has an ergonomic size, weight, and shape which makes it easy to comfortably hold in the hand, during use.

Figure 1A:
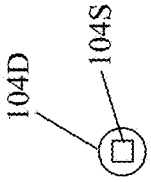
FIG. 1A is an end view of the key portion of the drum tuning key with elongated head shown in FIG. 1.

FIG. 1 illustrates a drum tuning apparatus 100. The drum tuning apparatus 100 may be formed with a shaft 103 that may be made of any suitable material including, but not limited to, wood. The shaft 103 may extend at least from a first end 101 to a second end 102, which first and second ends of the shaft may be separated by a distance L. In one embodiment the drum tuning apparatus may be formed with a percussion mallet tip 101T at only the first end 101 of the shaft 103. It is noted that a "mallet" (or "beater") is known in the art as an object that is used to strike or beat a percussion instrument to cause it to produce its unique sounds, and may include various different drum sticks with different tips, brushes that are typically used with snare drums, hammers used with a xylophone, wands, rutes, tippers, etc. In another embodiment the drum tuning apparatus may be formed with a first percussion mallet tip 151 at the first end 101 of the shaft 103, and also a second percussion mallet tip 152 at the second end 102 of the shaft 103, which mallet tips may be different (e.g., the first mallet tip may be a snare drum tip and the second mallet tip may be a tip that is used for a bass drum). A central portion of the shaft 103 may have a member 104 extending laterally away from (i.e., transversely with respect to) its axis 100X forming an elongated shape. A distal portion 104D of the member 104 may have a cylindrical outer surface, as seen in FIG. 1A. The cylinder of the distal portion 104D may have an orifice 104S formed therein that may be shaped (e.g., having a rectangular shape) and may be sized to correspond to the lug 51 of the tension rods 52 of a drum 50 (see FIG. 13), which are mostly standard. i.e., 4/16", although some are 5/32" (4 mm) tending to be used only for Zither pins.

A proximal portion 104P of the member 104 may be any suitable shape, and as seen in FIG. 1, it may be received within a correspondingly shaped recess formed in the shaft 103. For the drum tuning apparatus 100, in one embodiment the proximal portion 104P of the member 104 may be fixedly secured to the shaft 103 using any suitable joining technique known in the art, including, but not limited to adhesive bonding, a friction fit, mechanical fasteners, etc. In one embodiment, the proximal portion 104P of the member 104 may be releasably secured to the shaft 103 using a stainless steel locking screw 105, which may permit replacement of the member 104. The length of the proximal portion 104P of the member 104 may provide some separation between the top of the drum and the shaft 103. In one embodiment the member 104 may be secured to be substantially centered on the shaft 103 such that the length portion Li is roughly equal to the length portion Lii.

Figure 11:
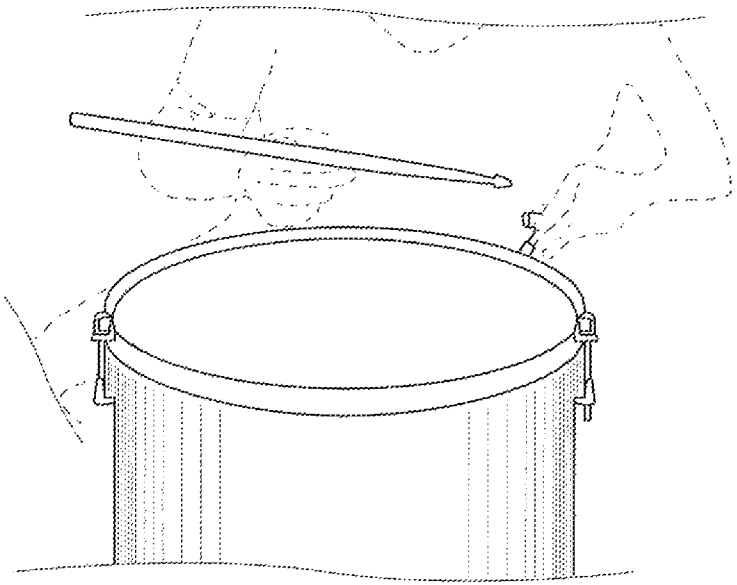
FIG. 11 illustrates a second prior art step in fine tuning of a drum in which the batter head may have produced a sound at a lug location that may be low or high with respect to a musical note to which the head is being tuned, which is then adjusted using the key held in the first hand, which may repeatedly go back and forth between holding the resonant head and making small tension adjustments to the lugs.
Figure 10:
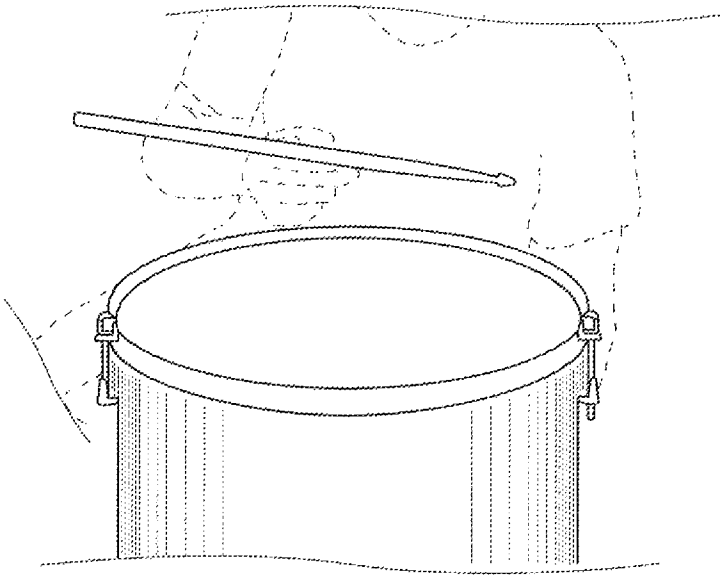
FIG. 10 illustrates a prior art step in fine tuning of a drum in which a first hand is used to grasp a prior art drum key while holding the resonant head to keep it from resonating to get a good clear tone from the batter head, while a drum stick is held in the second hand and is used to successively tap on the batter head proximate to each lug location.

A prior art method for a fine tuning step for a drum may be seen in FIG. 10 and FIG. 11. FIG. 10 illustrates the prior art step of fine tuning of a drum in which a first hand is used to grasp a prior art drum key while contacting the resonant head to keep it from resonating to get a good clear tone from the batter head, while a drum stick is held in the second hand and is used to successively tap on the batter head proximate to each lug location. FIG. 11 illustrates the second prior art step in fine tuning of a drum in which the batter head may have produced a sound at a lug location that may be low or high with respect to a musical note to which the head is being tuned, which location is then adjusted using the key held in the first hand, which may repeatedly go back and forth between holding the resonant head and making small tension adjustments to the lugs.

Figure 13:
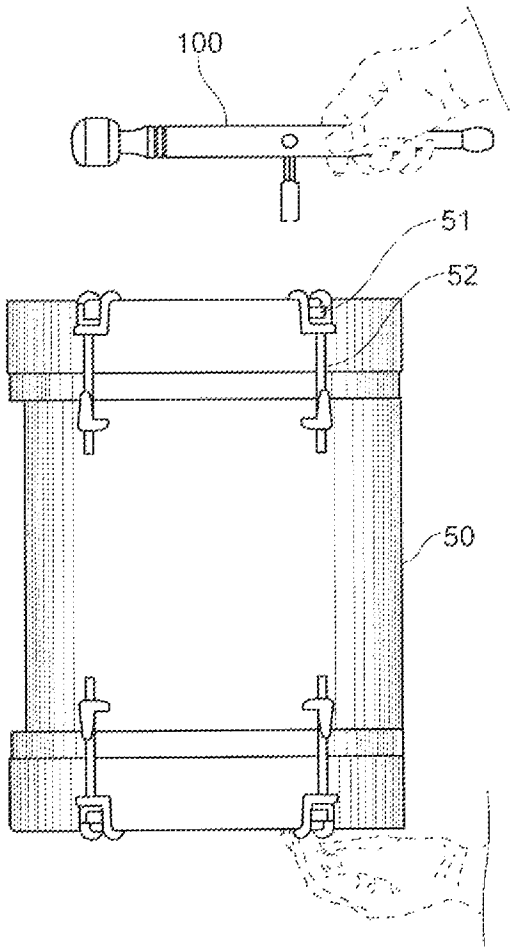
FIG. 13 illustrates a second step of fine tuning of a drum using the apparatus of the present invention.
Figure 12:
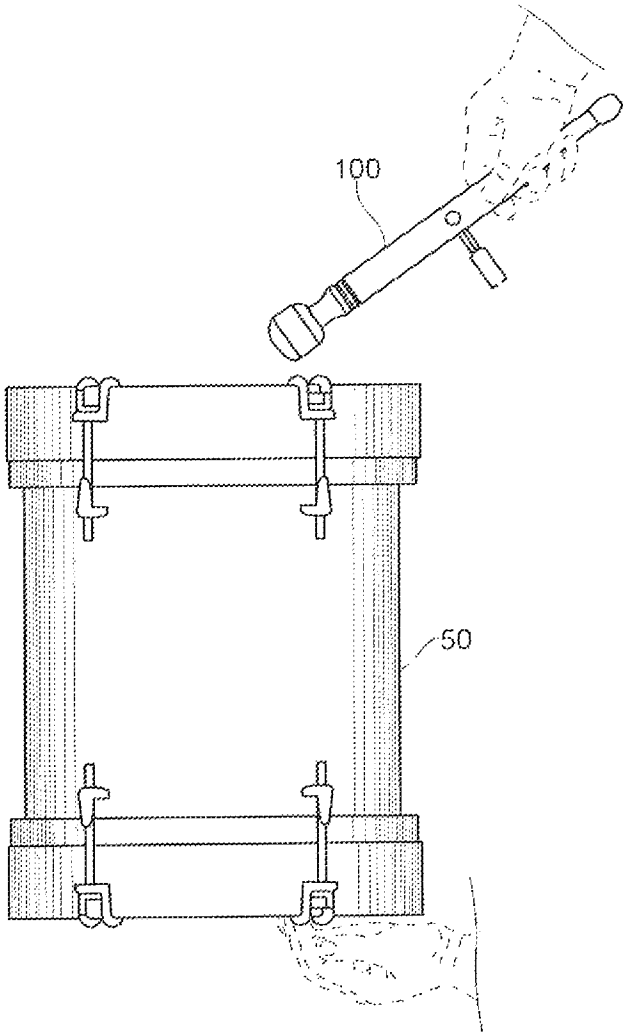
FIG. 12 illustrates a first step of fine tuning of a drum using the apparatus of the present invention.

A method for fine tuning of a drum in accordance with the present invention using the drum tuning apparatus 100 may be seen in FIG. 12 and FIG. 13.

FIG. 12 illustrates a first step of fine tuning of a drum using the drum tuning apparatus 100 in which a first hand (e.g., the left hand) is used to contact the resonant head of the drum to keep it from resonating to get a good clear tone from the batter head, while the shaft 103 of the drum tuning apparatus 100 is held in the second hand and is used to successively tap on the batter head proximate to a lug location.

FIG. 13 illustrates a second step of fine tuning of a drum using the drum tuning apparatus 100, in which the person's first hand may remain in contact with the resonant head, while the user's right hand may position the rectangular shaped orifice 104S of the distal portion 104D of the member 104 onto the lug 51 to accomplish tension adjustments thereto.

The arrangement of the drum tuning apparatus 100 thus creates a synergist effect in that it better enables the person tuning the drum to do so more easily, and more quickly, and to also tune different types of percussion instruments without having to use a different tool or tools. Additionally, rather than using both the person's dominant hand and non-dominant hand, as with the prior art method and key, to respectively do the tapping with a drum stick and the tension adjustments with the tuning key, use of the drum tuning apparatus 100 permits the person to use only the non-dominant hand for merely maintaining contact with the resonant head, which requires little or no dexterity, and to use the dominant hand for both the tapping and the tension adjustment, which does require some dexterity.

Figure 14:
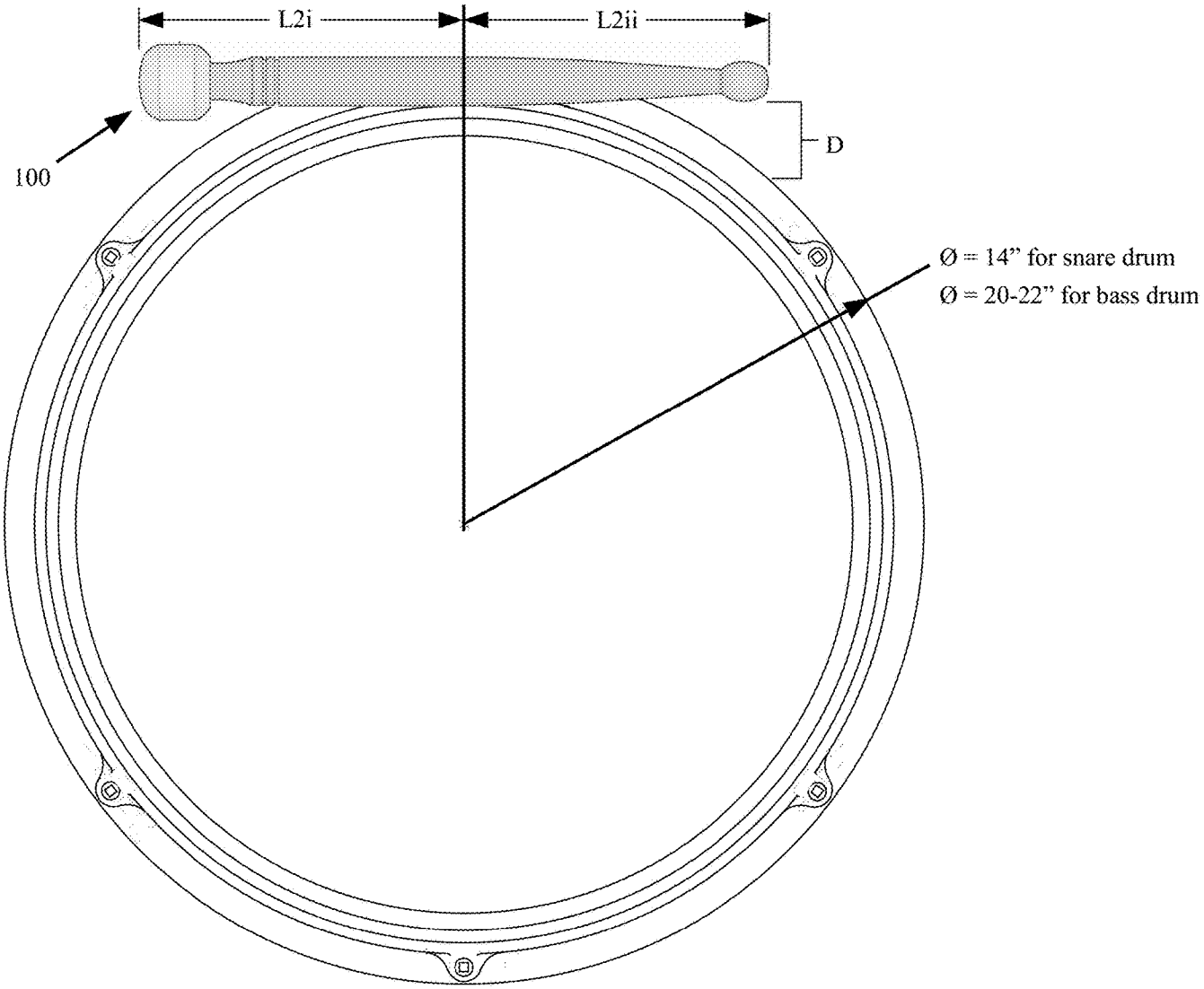
FIG. 14 illustrates dimensional relationships between a snare/bass drum, and a drum tuning key with elongated head formed as a double-ended mallet in accordance with one embodiment of the present invention.

The drum tuning apparatus 100 may be further configured to provides other advantageous benefits. As seen in FIG. 14, the length L2*ii* (and length L2*i*) may be coordinated with respect to the particular drum (e.g., typically a 14 inch diameter for a snare drum, and a 20-22 inch diameter for a bass drum) to provide a gap D at its distal end with respect to the drum casing to leave room for at least one finger to extend downward to actuate the shaft 103 to rotate. The length L2*ii* (and length L2*i*) may also be better suited for the user to be able to more precisely judge 180 degrees of rotation for the earlier course tuning steps, due to the length of the shaft 103 providing a better visual indication by extending over a significant portion (i.e., over 50%) of the extent of the drum for the snare drum, as opposed to the small wings of typical drum tuning keys (see e.g., U.S. Pat. No. 151,797 and U.S. Pat. No. 9,934,764).

Therefore, as seen in FIG. 14, for a snare drum having a 14 inch diameter, to create a gap D of about 1.0 inches, the distance L2*ii* may preferably be roughly 3.5 inches (or slightly longer), and for a little extra room, to create a gap D of about 1.25 inches the distance L2*ii* may thus preferably be roughly 4.0 inches. So where L2*i*=L2*ii*, the shaft 103 may be roughly 7.5 inches to 8.0 inches in length.

For a bass drum having a 20-22 inch diameter, to create a gap D of about 1.0 inches the distance L2*ii* may preferably be roughly 4.8 inches (or slightly longer), and for a little extra room, to create a gap D of about 1.25 inches the distance L2*ii* may thus preferably be roughly 5.1 inches. So where L2*i*=L2*ii*, the shaft 103 may be roughly 9.5 inches to 10.2 inches in length.

It is also noted that the length L2*ii* (and length L2*i*) of the shaft 103 being at least 7.5 to 8.0 inches may also be better suited for the user to be able to more precisely judge the degree to which small incremental rotational amounts are made for the fine tuning steps, due to the length of the shaft 103 providing a better visual indication for that purpose as well.

As noted above, another advantage of the drum tuning apparatus 100 may be provided by utilizing a snare drum tip 151 at the first end 101 of the shaft 103, and a bass drum tip 152 at the second end 102 of the shaft 103, so that the same tuning key/mallet may be used for those two different percussion instruments. Additionally, one portion of the shaft 103 (e.g., length Lii) may be sized for use on the snare drum, while a second portion of the shaft 103 (e.g., length Li) may be sized for use on the bass drum. Other tip combinations may also be used in other embodiments, and which may include, but is not limited to, a round rubber mallet tip (see FIG. 4).

Figure 2:
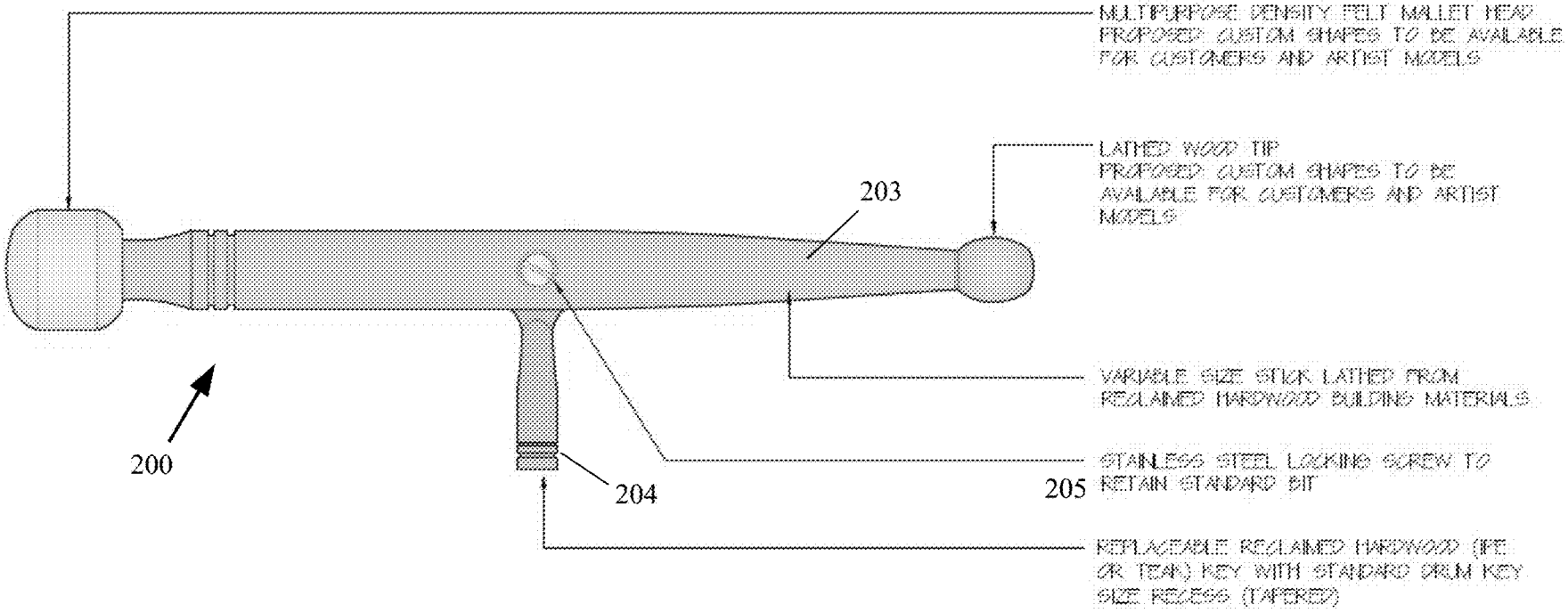
FIG. 2 illustrates a drum tuning key with elongated head formed as a double-ended mallet in accordance with a second embodiment of the present invention.

FIG. 2 illustrates a drum tuning apparatus 200, which may be formed substantially the same as the drum tuning apparatus 100. However, for the drum tuning apparatus 200 the shaft 203 and the member 204 may both be made of wood, and may be formed of a single piece of wood, being turned on a lathe in one embodiment, or may alternatively be separate wood parts that may again be joined using a screw 205.

Figure 3:
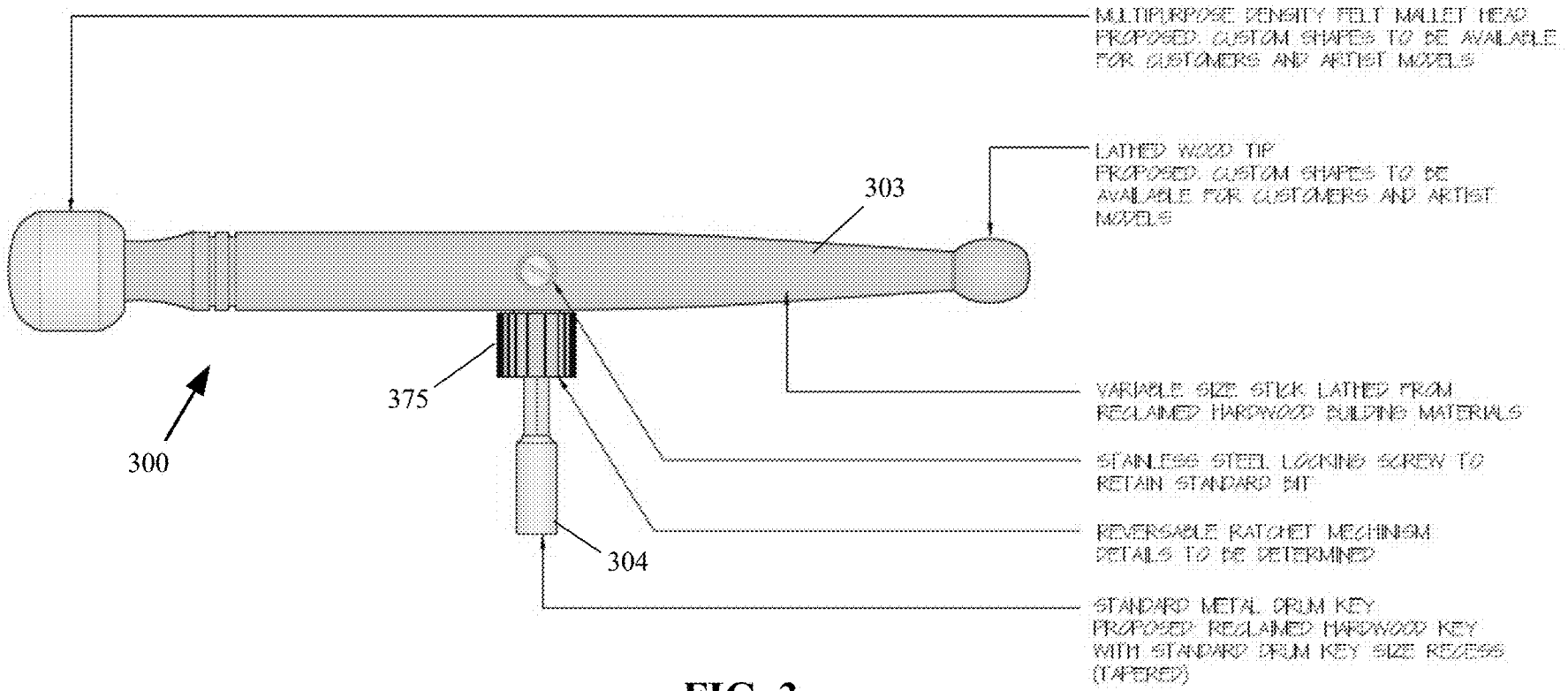
FIG. 3 illustrates a drum tuning key with elongated head formed as a double-ended mallet in accordance with a third embodiment of the present invention.

FIG. 3 illustrates a drum tuning apparatus 300, which may be formed substantially the same as the drum tuning apparatus 100. However, for the drum tuning apparatus 300 the member 304 may be coupled to the shaft 303 through a ratchet arrangement 375, which may be reversible, similar to a ratchet wrench.

Figure 4:
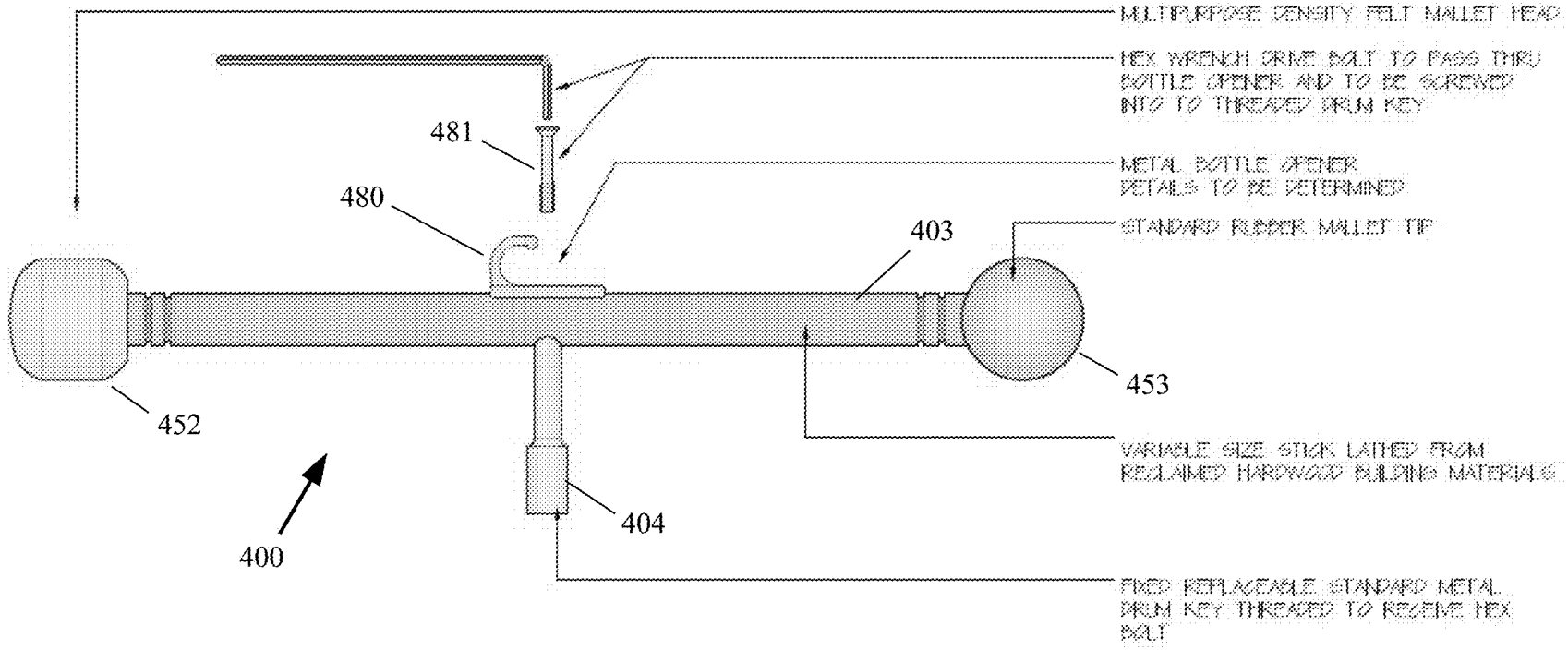
FIG. 4 illustrates a drum tuning key with elongated head formed as a double-ended mallet in accordance with a fourth embodiment of the present invention.

FIG. 4 illustrates a drum tuning apparatus 400, which may be formed substantially the same as the drum tuning apparatus 100. However, the drum tuning apparatus 400 may have a bass drum tip 452 at the second end of the shaft 403, and a round rubber mallet tip 453 at the first end of the shaft. The drum tuning key apparatus 400 may also have a bottle opener 480 coupled to the shaft 403 using, for example, a bolt, or screw 481, or other suitable mechanical fastener. The bolt 481 may also be used to simultaneously secure the member 404 to the shaft 403, which member 404 may have internal recess at the distal end to receive a hex head therein.

Figure 5:
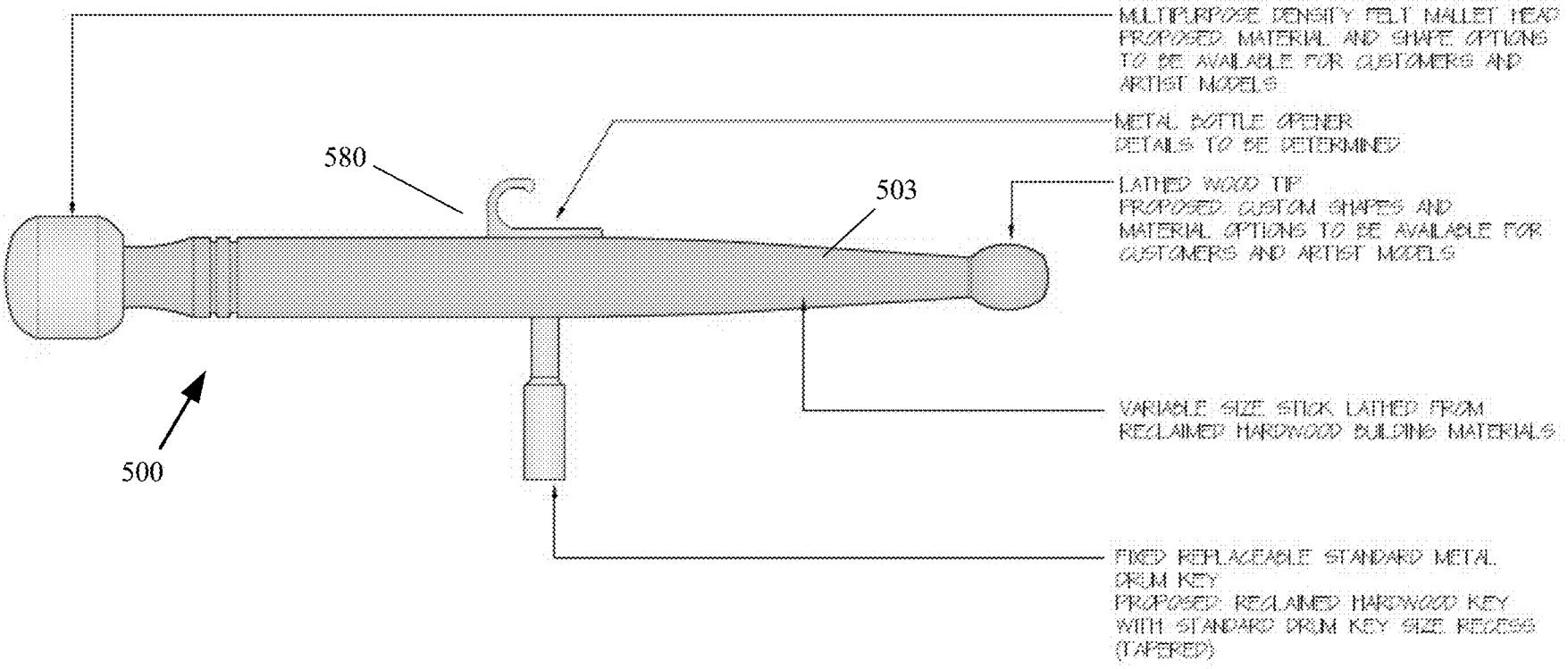
FIG. 5 illustrates a drum tuning key with elongated head formed as a double-ended mallet in accordance with a fifth embodiment of the present invention.

FIG. 5 illustrates a drum tuning apparatus 500, which may be formed substantially the same as the drum tuning apparatus 100, but which may also include a bottle opener 580 coupled to the shaft 503.

Figure 6:
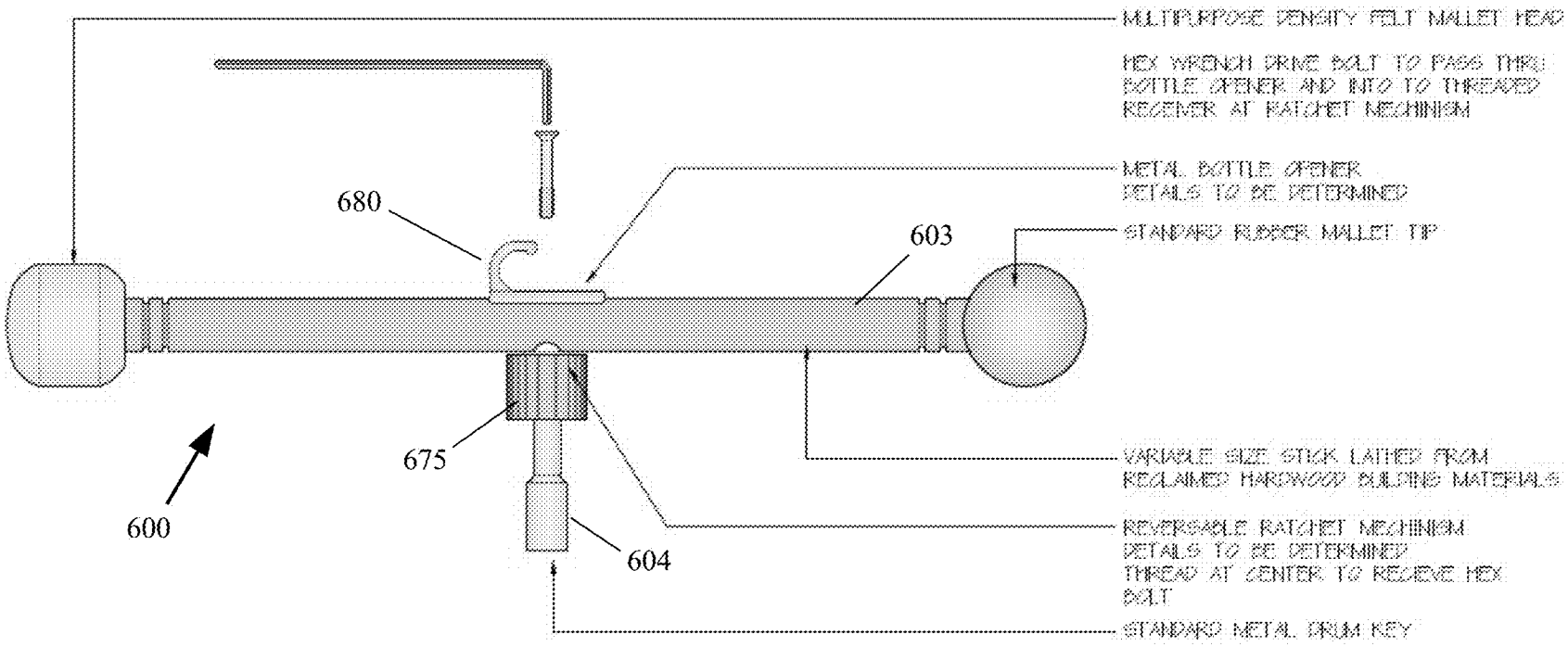
FIG. 6 illustrates a drum tuning key with elongated head formed as a double-ended mallet in accordance with a sixth embodiment of the present invention.

FIG. 6 illustrates a drum tuning apparatus 600, which may be formed substantially the same as the drum tuning apparatus 100, but which may also include a bottle opener 680 coupled to the shaft 603, and with the member 604 coupled to the shaft 603 through a ratchet arrangement 375.

Figure 7:
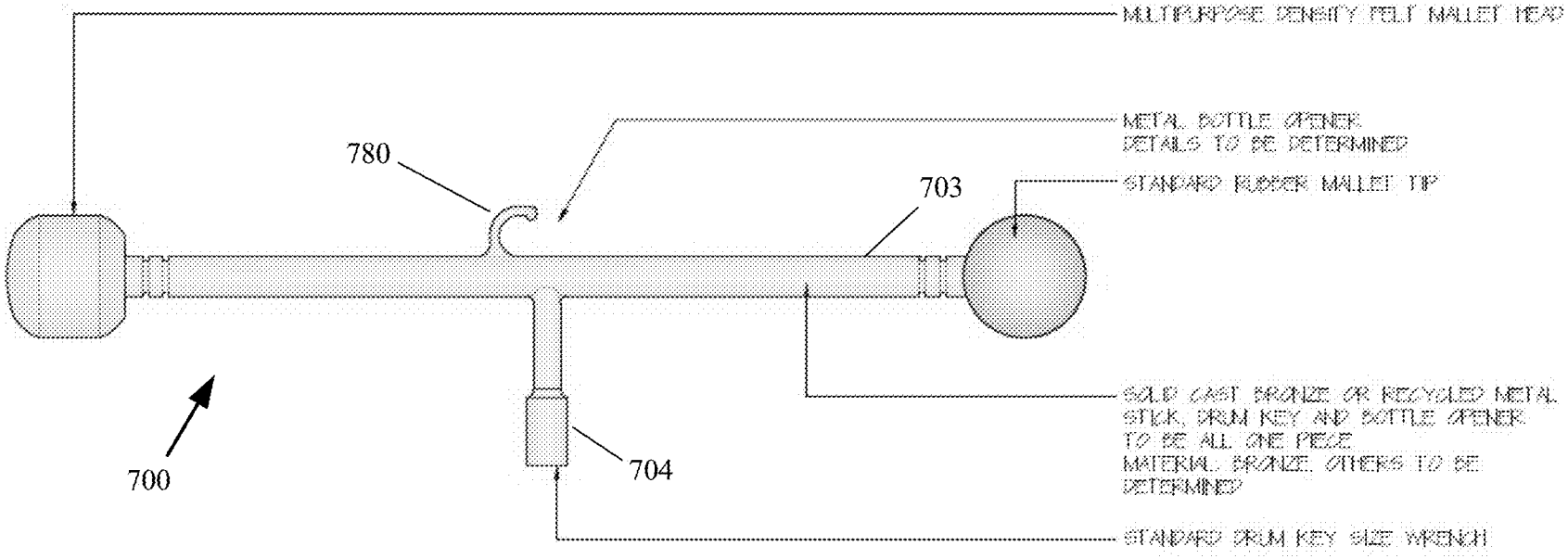
FIG. 7 illustrates a drum tuning key with elongated head formed as a double-ended mallet in accordance with a seventh embodiment of the present invention.

FIG. 7 illustrates a drum tuning apparatus 700, which may be formed similar to the drum tuning apparatus 400, but which may have the shaft 703, the member 704, and the can opener 780 integrally formed as a single unitary part. The unitary shaft 703, member 704, and can opener 780 may be formed through a casting or other suitable process, and may be formed of any suitable material, including, but not limited to, a bronze material.

Figure 8:
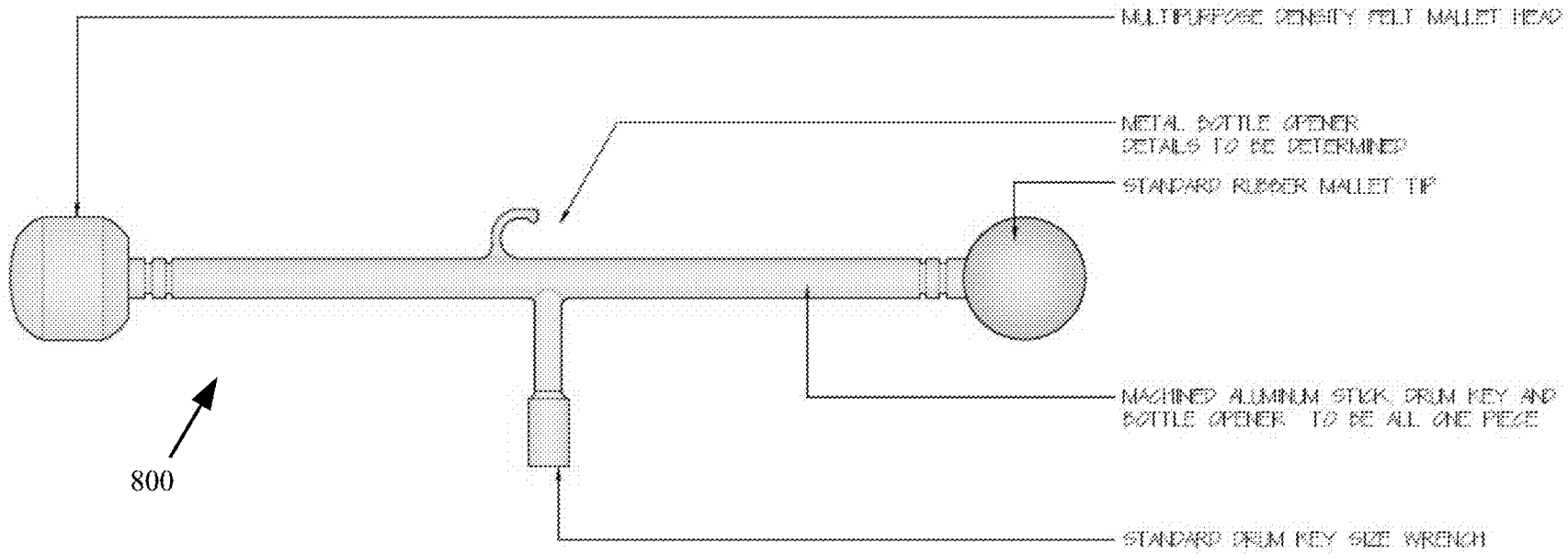
FIG. 8 illustrates a drum tuning key with elongated head formed as a double-ended mallet in accordance with an eighth embodiment of the present invention.

FIG. 8 illustrates a drum tuning apparatus 800, which may be formed substantially the same as the tuning apparatus 700, but which may be a machined part, and may be machined from any suitable material, including, but not limited to, an aluminum material.

Figure 9:
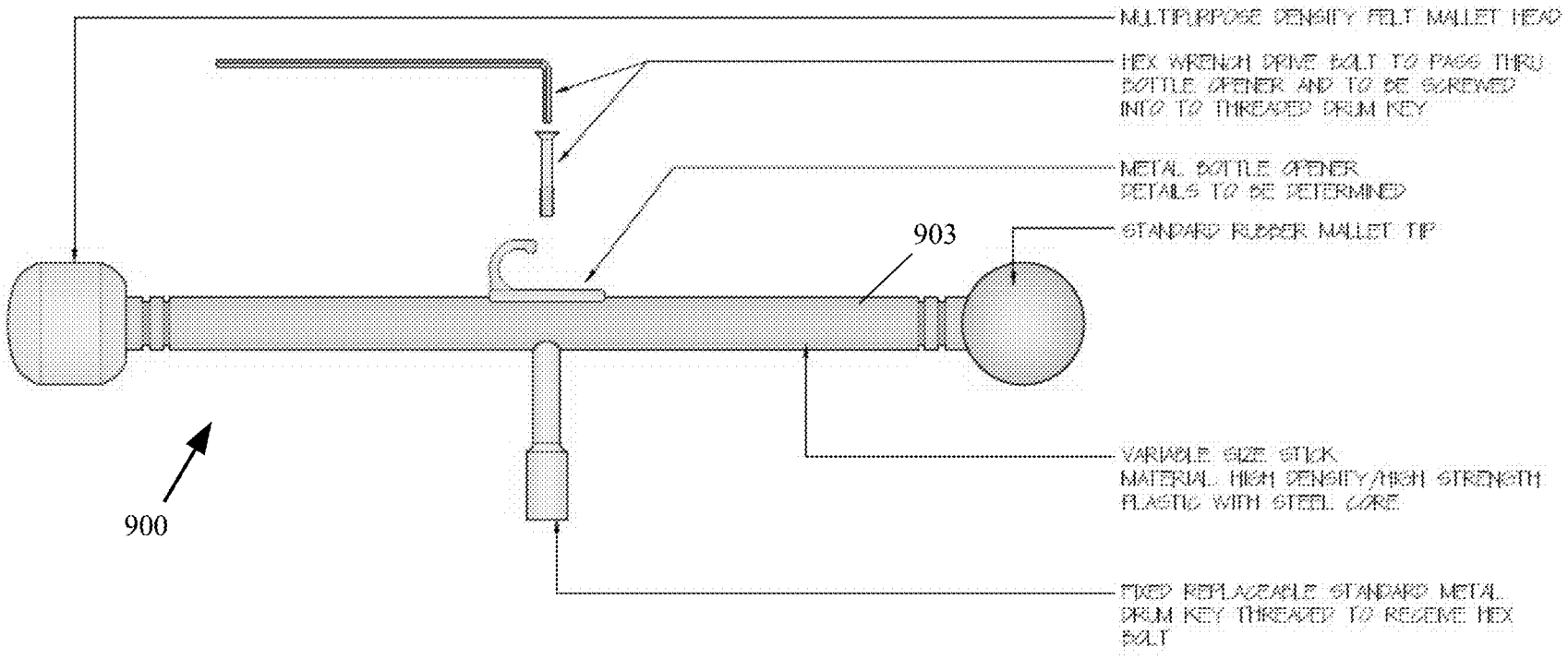
FIG. 9 illustrates a drum tuning key with elongated head formed as a double-ended mallet in accordance with a ninth embodiment of the present invention.

FIG. 9 illustrates a drum tuning apparatus 900, which may be formed substantially the same as the drum tuning apparatus 400, but where the shaft 903 may be made of a high density, high strength plastic with a steel core.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A drum tuning apparatus configured to tune a plurality of different types of percussion instruments, said drum tuning apparatus comprising:

a shaft that extends from a first end to a second end, said first end of said shaft separated from said second end of said shaft by a distance L;

a percussion mallet tip formed on said first end of said shaft;

an elongated member that extends from said shaft substantially transverse with respect to an axis of said shaft; a distal end of said elongated member comprising an opening defining a recess; and wherein said recess is shaped and sized to receive a lug of a drum tension rod therein.

2. The drum tuning apparatus according to claim 1, wherein a second percussion mallet tip is formed on said second end of said shaft; and wherein said drum tuning apparatus is configured to tune different types of percussion instruments without having to use different tools.

3. The drum tuning apparatus according to claim 2, wherein said first percussion mallet tip comprises a snare drum tip, and said second percussion mallet tip comprises a bass drum tip.

4. The drum tuning apparatus according to claim 3, wherein an outer surface of said elongated member proximate to its distal end comprises a cylindrical surface.

5. The drum tuning apparatus according to claim 4, wherein a proximal portion of said elongated member is releasably secured to said shaft using a mechanical fastener.

6. The drum tuning apparatus according to claim 4, wherein said elongated member is integrally formed with said shaft.

7. The drum tuning apparatus according to claim 4, wherein a proximal portion of said elongated member is received in an orifice in said shaft in a friction fit to secure said elongated member to said shaft.

* * * * *